United States Patent [19]

Eckart

[11] 4,018,492

[45] Apr. 19, 1977

[54] ADVANCE GROUNDING SYSTEM FOR ELECTRICAL CONNECTORS

[75] Inventor: George R. Eckart, Arlington Heights, Ill.

[73] Assignee: Daniel Woodhead, Inc., Northbrook, Ill.

[22] Filed: Sept. 11, 1975

[21] Appl. No.: 612,340

[52] U.S. Cl. ..... 339/14 P; 339/191 S; 339/195 S

[51] Int. Cl.[2] ..... H01R 3/06

[58] Field of Search ..... 339/14 P, 14 R, 191 R, 339/191 M, 191 S, 192 R, 192 RL, 195 M, 195 S, 195 R

[56] References Cited

UNITED STATES PATENTS

| | | | |
|---|---|---|---|
| 3,381,258 | 4/1968 | Becker, Jr. | 339/14 P |
| 3,855,569 | 12/1974 | Tymkewicz | 339/191 R X |

*Primary Examiner*—Roy Lake
*Assistant Examiner*—DeWalden W. Jones
*Attorney, Agent, or Firm*—Johnson Dienner Emrich & Wagner

[57] ABSTRACT

An advance grounding system for electrical connectors includes a male attachment portion and a female receptacle portion. The male attachment portion contains a pair of current carrying electrical contact blades and a ground contact blade extending outwardly, with the ground blade having a length greater than the current carrying contacts. The female receptacle includes a pair of electrical terminals positioned in recesses and adapted to receive the current carrying contacts, and a ground terminal which extends to a point adjacent the inner face of the female receptacle. The ground terminal is arranged so that it is not possible for the current carrying blades to contact the female terminals before the ground blade contacts the female ground terminal when the male attachment portion is inserted into the female receptacle portion to complete the electrical connection.

3 Claims, 7 Drawing Figures

ADVANCE GROUNDING SYSTEM FOR ELECTRICAL CONNECTORS

BACKGROUND OF THE INVENTION

In electrical connectors particularly for use in hospitals and in other areas where flammable gases or vapors are encountered, it is necessary to provide a grounded receptical device for electrically operated equipment, to prevent voltage leakages which could cause sparks, thereby resulting in explosions of the hazardous and flammable gases and vapors surrounding such electrical connections. Additionally, precision electronic instruments utilized in hospitals and other type laboratories must be protected from voltage leakages which may be critical to the efficiency and accuracy of the instrument for instrument readings. Also, the prevention of shock producing voltage leakage to personnel attending equipment must be considered.

In the past, most devices in use for accomplishing the grounding of electrical devices, in hospitals and other areas containing complicated electronic equipment as well as hazardous vapors and gases, have included the use of a standard receptacle adapted to receive a three-way plug wherein one of the conductors is a grounding blade. However, these devices do not provide a fail-safe device wherein the electrical connections can be made only after the ground contact has been engaged with the ground terminal. Consequently, such devices have failed to provide a tamper-proof fail-safe device which provides that before the electrical contacts between the plug and receptacle can be made the ground connection must be completed.

SUMMARY OF THE INVENTION

It is a primary object of this invention to provide a fail-safe grounding connection, wherein the ground contact blade must be engaged with the ground terminal prior to the contact between the current carrying blades and the electrical terminals to complete the electrical circuit.

In a preferred embodiment of the present invention, the advance grounding system or device includes a male attachment portion having a pair of electrical current carrying contact blades secured in the attachment portion and extending outwardly therefrom. A ground contact blade is also secured in the male attachment portion and extends outwardly therefrom, the length of the ground contact blade being greater than the length of either of the electrical contact blades. A female receptacle member is provided and includes a pair of electrical terminals mounted in recesses therein which terminate adjacent openings in the cover of the receptacle member. The electrical terminals are adapted to receive and to be engaged by the electrical contact blades upon the insertion of the male portion into the female receptacle member to complete the electrical connection. The receptacle terminal further includes a ground terminal positioned therein which extends through an opening therein substantially to the surface of the receptacle member, the ground terminal being adapted to be engaged by the ground contact blade upon insertion of the blade into the female attachment portion. When the male attachment portion is inserted into the female receptacle member, the ground contact blade engages the ground terminal before either of the current carrying contact blades is engaged with the electrical terminals regardless of the angle or position of the male portion with respect to the female receptacle.

DETAILED DESCRIPTION

Figure 1:
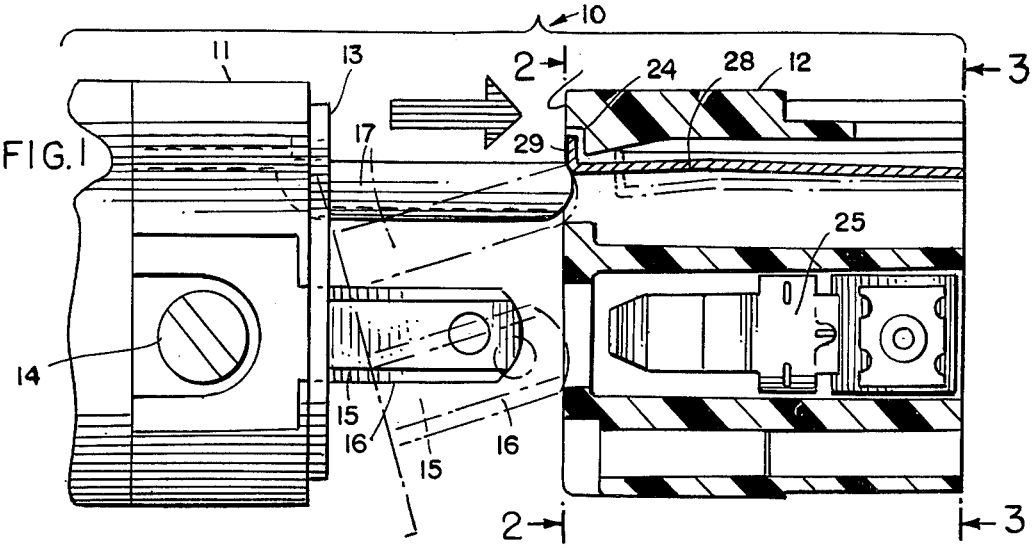
FIG. 1 is a side elevational view partly in the section, of the advance grounding system of the present invention showing the male attachment portion being inserted into the female receptacle member with the grounding blade and contact touching.
Figure 2:
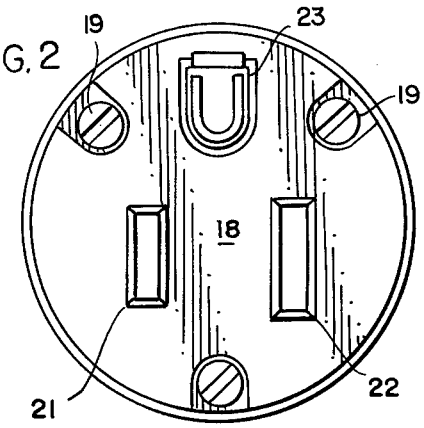
FIG. 2 is an end elevational view looking in the direction of the arrows along the plane of line 2—2 of FIG. 1, showing the inner face of the female receptacle with the female grounding terminal in accordance with the present invention.
Figure 3:
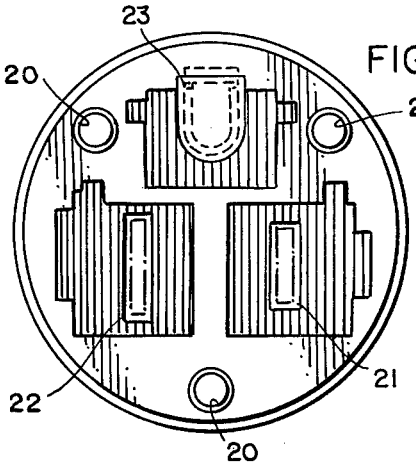
FIG. 3 is an end elevational view of the female receptacle looking in the direction of the arrows along the plane of line 3—3 of FIG. 1, showing the female receptacle terminal in accordance with the present invention.

Referring now to the drawings, in which like reference numerals are used throughout to identify the same parts, in FIG. 1 the advance grounding system or device 10 of the present invention includes a male attachment plug or portion 11 and a female receptacle or portion 12. The advance grounding device 10 is preferably composed of an opaque, translucent or transparent plastic or thermo-setting synthetic polymer, e.g., Lexan (trademark), a polycarbonate polymer or resin. The male attachment plug 11 includes a dead front face cover 13 which is conventionally mounted to the male attachment plug by screws and fasteners (not shown), as is known in the art. The so-called dead face cover 13 results from back wiring of the rearwardly located terminal posts 14 (only one is shown) for the male electrical contact blades 15 and 16 which project outwardly from the dead front face cover 13. The male ground contact or blade 17 is provided to project from the dead front face 13. The male ground blade 17 extends outwardly farther than either of the male electrical blades 15 and 16, as is known in the art. Preferably, the width of one of the male electrical contact blades 15 or 16 is greater than the width of the other of the male electrical contact blades 15 or 16, to provide a safety factor and to insure the proper orientation upon insertion of the male attachment plug 11 into the female receptacle member 12, as will hereinafter be described. The configuration and orientation of electrical contact blades 15 and 16, and the ground contact blade 17 on the dead front face 13 of the attachment plug 11, is but one type of many which may be used. Other configurations and orientations for contact blades and ground blades may be used instead of that shown in the illustrated embodiment.

The female receptacle member 12 includes a face or cover plate 18 which includes a plurality of openings or holes 20 therein which are adapted to receive screws or other type of fasteners 19, which hold the cover 18 assembled with the female receptacle member 12, as is known in the art.

The cover 18 of receptacle member 12 includes openings or slots 21 and 22 therein which are adapted to receive the male current carrying contacts 15 and 16, respectively, of the male attachment plug 11. Additionally, the cover plate 18 includes an opening 23, which is adapted to receive the ground terminal 28, as will hereinafter be described. The opening 23 is provided with an offset, or cut-out portion 24 in the face 18 for a purpose which will appear more fully hereinafter. The slots 21 and 22 cooperate with electrical plug receiving sockets 25 (only one shown in FIG. 1) which conventionally are mounted within the female receptacle member 12.

Figure 4:
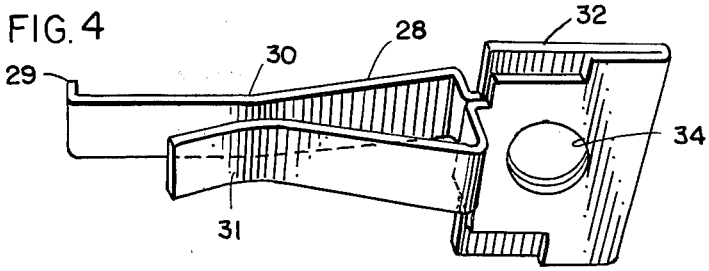
FIG. 4 is a perspective view of one form of a female ground terminal in accordance with the present invention.

An important safety feature provided by the present invention is the positioning and mounting of the ground receiving socket 28 in the female receptacle member 12. In the embodiment shown in FIGS. 1 and 4, the receptacle 28 for the grounding plug includes a body portion 30 terminating in an outwardly bent lip portion 29 at one end thereof and provided with a mounting portion 32 on the opposite end. Preferably, the mounting portion 32 contains an opening 34 therein which opening is adapted to receive a screw or other fastening device such as that shown at 35 in FIG. 6, for mounting the ground terminal 28, within the female receptacle member 12. When the ground terminal 28 has been mounted within the female receptacle member 12, the lip portion 29 is positioned to rest in cut-out portion 24 in the face 18 of the receptacle member. By so positioning the ground terminal 28 and lip portion 29 thereof in cut-out portion 24, the grounding terminal extends substantially to the face 18 of the female receptacle member 12. Accordingly, when the male attachment plug 11 is brought into engagement with the female receptacle member 12, the male ground contact blade 17 must first touch the ground terminal 28 prior to the engagement of the male electrical contacts or blades 15 and 16 with the electrical plug receiving sockets 25.

Figure 5:
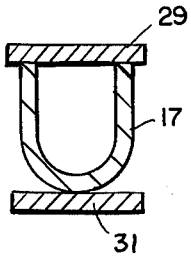
FIG. 5 is a transverse sectional view of the ground contact blade in full engagement with the ground terminal as depicted in FIG. 4.

The ground terminal 28 is preferably made of one-piece and includes a yieldable tongue portion 31 (FIG. 4) positioned adjacent and in spaced relation to the body portion 30 of the terminal. The tongue portion 31 is engageable with the end portion of the ground contact blade 17 when the male attachment plug 11 is inserted into the female receptacle member 12. As the ground contact blade 17 is inserted through opening 23 in the face 18 of the female receptacle member 12, the blade contacts the lip portion 29 of the ground terminal 28. As the ground blade 17 is further inserted into the female receptacle member 12, the blade contacts and biases outwardly the yieldable tongue portion 31 of the ground terminal 28. As shown in FIG. 5, the ground contact blade 17 is fully inserted into the ground terminal 28 and held firmly within the female receptacle 12 by yieldable tongue 31.

Figure 6:
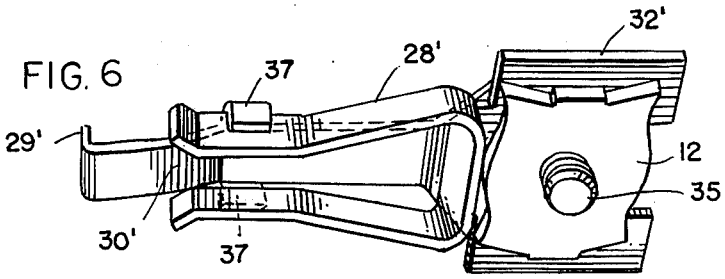
FIG. 6 is a perspective view of another form of a ground terminal in accordance with a further embodiment of the present invention.

In FIG. 6 a further embodiment of the ground or terminal socket is shown at 28' wherein the receiving socket includes a body portion 30' having a lip portion 29' and the end opposite thereof has a mounting portion 32' including an opening (not shown) for mounting to the female receptacle member 12 (partially shown) by means of a screw or fastening means 35. Intermediate the length of the body portion 30', there is provided a pair of restraining arms 37, integral therewith and extending perpendicularly outwardly therefrom. A pair of yieldable tongues 31' extend longitudinally of and adjacent to the body portion 30' of the ground terminal 28'.

Thus, when the receiving socket 28' (FIG. 6) is mounted in the female receptacle member 12, the lip portion 29' is adapted to be received and rest in the recess or cut-out portion 24 of opening 23 in the face 18, such that the end of the socket or terminal extends to the face of the female receptacle member.

Figure 7:
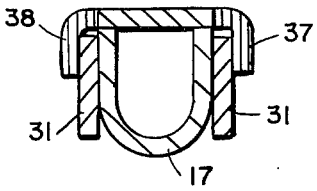
FIG. 7 is a transverse sectional view of the ground contact blade in full engagement with the ground terminal as depicted in FIG. 6.

Upon insertion of male plug 11 and the ground contact blade 17 through opening 23 in face plate 18, the end of the ground blade must first engage the lip portion 29' of the terminal 28' prior to the electrical contact blades 15 and 16 engaging the electrical plug receiving sockets 25. Upon the further insertion of the ground contact blade 17 into the female receptacle member, the ground contact blade engages the pair of yieldable tongues 31' to bias them outwardly. until the tongues engage arm portions 37, as shown in FIG. 7. When the ground contact blade 17 and the attendant male attachment plug 11 are fully inserted into the female receptacle member 12, the ground contact blade is firmly held in engagement with the ground terminal 28' to ensure a proper and safe connection between the ground blade and ground socket.

The present invention provides a unique female ground receptacle member wherein it is not possible to insert the ground blade into the female receptacle without the ground blade first contacting the female ground receptacle, before the current carrying blades can reach the female electrical contacts, regardless of the position of the male plug at the time of insertion. This safety feature prevents voltage leakage between the terminal posts and prevents any users of the present advance grounding system and apparatus from accidental shock which might otherwise occur.

Although the present invention has been described with respect to certain specific embodiments, it is contemplated that modifications and changes may be made by those skilled in the art without departing from the spirit and scope of the present invention.

I claim:

1. An advance grounding system for electrical connectors, including in combination, a male attachment portion, electrical current carrying contact blades secured in said male attachment portion and extending outwardly therefrom, a ground contact blade secured in said male attachment portion and extending outwardly therefrom, the length of said ground contact blade being greater than the length of said electrical contact means, a female receptacle portion having therein a cut-out portion in the face thereof and female terminal means adated to receive the blades on said male attachment portion, the female ground terminal means which receives the ground contact blade having an angularly extending lip portion on the outer end thereof received in said cut-out portion so that said terminal means will terminate substantially at the face of the female receptacle portion, and the female terminal means which receive the other contact blades terminating short of the face of said female receptacle portion, whereby, upon the insertion of said attachment portion into said female receptacle portion, said ground contact blade will contact the female ground terminal means before the electrical circuit can be completed by contact of the current carrying contact blades with the female terminal means regardless of the position assumed by said male attachment portion at the time of insertion into said receptacle portion.

2. An advance grounding system in accordance with claim 1 wherein said female ground terminal means further includes yieldable means positioned adjacent said body portion of said ground terminal means, whereby, upon the insertion of said male attachment portion into said female receptacle portion, said ground contact blade will engage said yieldable means to bias the same outwardly to firmly hold said contact blade in engaging contact with said ground terminal means.

3. An advance grounding system in accordance with claim 1 wherein said female ground terminal means includes a body portion positioned in said female receptacle means said body portion having a pair of restraining arms integral therewith and extending perpendicularly outwardly therefrom and yieldable means positioned adjacent said body portion and between said restraining arms, and movable between a first position away from said pair of arms and a second position engageable with said pair of arms when said ground contact blade is inserted into said ground terminal means to engage and bias said spring means to said second position.

* * * * *